US010596825B2

(12) United States Patent
Katsumata

(10) Patent No.: US 10,596,825 B2
(45) Date of Patent: Mar. 24, 2020

(54) PRINTER AND PRINTER CONTROL METHOD

(71) Applicant: TOSHIBA TEC KABUSHIKI KAISHA, Shinagawa-ku, Tokyo (JP)

(72) Inventor: Akio Katsumata, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/292,106

(22) Filed: Mar. 4, 2019

(65) Prior Publication Data

US 2019/0193416 A1 Jun. 27, 2019

Related U.S. Application Data

(63) Continuation of application No. 15/982,003, filed on May 17, 2018, now abandoned, which is a (Continued)

(30) Foreign Application Priority Data

Feb. 8, 2017 (JP) ..... 2017-021165

(51) Int. Cl.
*B41J 2/325* (2006.01)
*B41J 3/407* (2006.01)
(Continued)

(52) U.S. Cl.
CPC ..... *B41J 2/325* (2013.01); *B41J 3/4075* (2013.01); *B41J 17/12* (2013.01); *B41J 33/388* (2013.01)

(58) Field of Classification Search
CPC . B41J 2/325; B41J 17/12; B41J 33/388; B41J 3/4075
See application file for complete search history.

(56) References Cited

U.S. PATENT DOCUMENTS 9,457,925 B1 10/2016 Harashina
9,463,640 B1 10/2016 Matsuda
(Continued)

FOREIGN PATENT DOCUMENTS

EP 3075550 10/2016
JP 05-50729 3/1993
JP 2004-174774 6/2004

OTHER PUBLICATIONS

Non-Final Office Action for U.S. Appl. No. 15/464,658 dated Oct. 19, 2017, 16 pages.
(Continued)

*Primary Examiner* — Kristal Feggins
(74) *Attorney, Agent, or Firm* — Amin, Turocy & Watson, LLP

(57) ABSTRACT

According to one embodiment, a thermal head is provided opposite to a platen roller. A ribbon transport unit transports an ink ribbon between the thermal head and the platen roller. A transport unit transports a sheet carrying a label between the thermal head and the platen roller. A clamping mechanism clamps the ink ribbon, a printing area of the label and the sheet in the thermal head and the platen roller. An acquisition unit acquires first print data to be printed on a first label and second print data to be printed on a second label. A non-printing area specifying unit specifies a non-printing area on the sheet, based on the first print data and the second print data. The control unit separates the ink ribbon and the sheet when it is transported between the thermal head and the platen roller, and stops the transport of the ink ribbon.

9 Claims, 5 Drawing Sheets

Related U.S. Application Data continuation of application No. 15/464,658, filed on Mar. 21, 2017, now Pat. No. 10,000,070.

(51) Int. Cl.
*B41J 17/12* (2006.01)
*B41J 33/388* (2006.01)

(56) References Cited

U.S. PATENT DOCUMENTS

| | | | |
|---|---|---|---|
| 9,840,102 | B2 | 12/2017 | Matsuda |
| 2014/0036019 | A1 | 2/2014 | Mori |
| 2016/0096382 | A1 | 4/2016 | Kojima |
| 2016/0288528 | A1 | 10/2016 | Matsuda |
| 2016/0375710 | A1 | 12/2016 | Matsuda |
| 2018/0056687 | A1 | 3/2018 | Matsuda |

OTHER PUBLICATIONS

Extended European Search Report for European Patent Application No. 18154953.6 dated Jul. 12, 2018.
Non-Final Office Action for U.S. Appl. No. 15/982,003 dated Oct. 4, 2018, 18 pages.
Chinese Office Action for Chinese Patent Application No. 201810105916.1 dated Apr. 2, 2019.

PRINTER AND PRINTER CONTROL METHOD

CROSS-REFERENCE TO RELATED APPLICATIONS

This application is a Continuation of application Ser. No. 15/982,003 filed May 17, 2018, which is a Continuation of application Ser. No. 15/464,658 filed Mar. 21, 2017, now U.S. Pat. No. 10,000,070, the entire contents of both of which are incorporated herein by reference.

This application is based upon and claims the benefit of priority from Japanese Patent Application No. P2017-021165, filed Feb. 8, 2017, the entire contents of which are incorporated herein by reference.

FIELD

Embodiments described herein relate generally to a printer that prints characters, two-dimensional barcodes, and the like.

BACKGROUND

In the related art, a ribbon transfer type printer is equipped with a function (ribbon saving) of reducing consumption of an ink ribbon by stopping transport of an ink ribbon to a non-printing area. Although the condition for performing ribbon saving depends on the dimension of the non-printing area, in the related art, since it is determined whether or not to perform ribbon saving based on only the dimension of the non-printing area in one piece of printing layout, consumption of the ink ribbon may efficiently not be reduced.

DETAILED DESCRIPTION

An object of an exemplary embodiment is to provide a printer capable of performing ribbon saving more efficiently by optimally performing ribbon saving.

In general, according to one embodiment, a printer includes a thermal head, a platen roller, a ribbon transport unit, a transport unit, a clamping mechanism, an acquisition unit, a non-printing area specifying unit, and a control unit.

The thermal head thermally transfers ink of an ink ribbon to a label. The platen roller is provided opposite to the thermal head. The ribbon transport unit transports the ink ribbon between the thermal head and the platen roller. The transport unit transports a sheet carrying the label between the thermal head and the platen roller such that a printed surface of the label and the thermal head face each other across the ink ribbon. The clamping mechanism clamps or separates the thermal head and the platen roller. The acquisition unit acquires first print data to be printed on a first label and second print data to be printed on a second label, the second label being adjacent to the first label on the sheet. The non-printing area specifying unit specifies a non-printing area on the sheet, based on the first print data and the second print data. The control unit separates the ink ribbon from the sheet and stops transport of the ink ribbon by the ribbon transport unit, when the transport unit transports the non-printing area on the sheet between the thermal head and the platen roller.

Hereinafter, an embodiment will be described with reference to the drawings.

Figure 1:
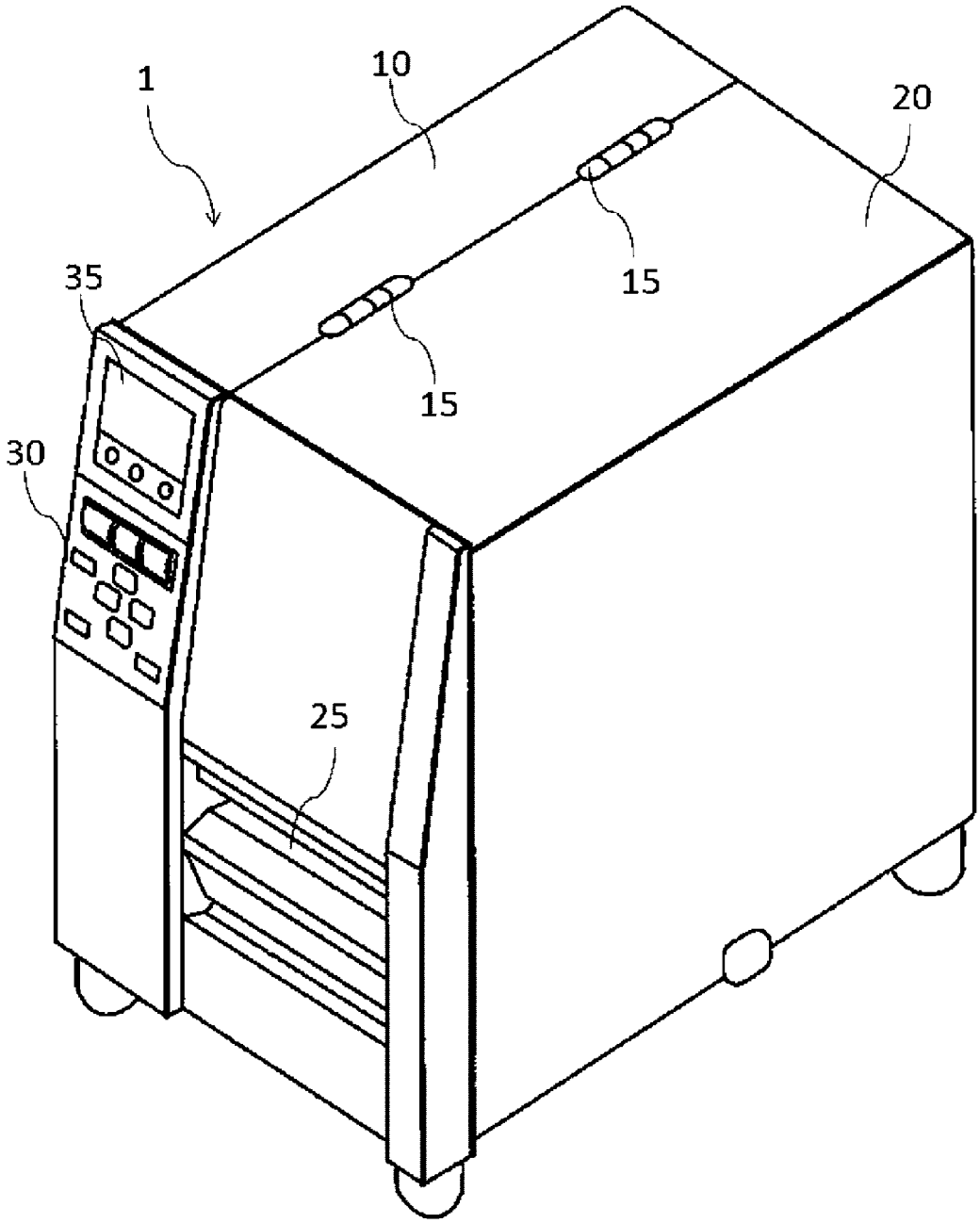
FIG. 1 is a perspective view of a label printer according to an embodiment.

FIG. 1 is a perspective view illustrating an overall configuration of a label printer 1 according to the embodiment.

The label printer 1 includes a control box 10 storing a printer engine, and a cover 20 rotatably connected to the control box 10 by a hinge 15. In addition, a discharge port 25 for discharging a printed label 54 is provided on the front side of the cover 20, and an operation unit 30 and a display unit 35 that displays operation information and an operation menu are provided on the front side of the control box 10. The display unit 35 is configured with a liquid crystal screen or the like.

Figure 2:
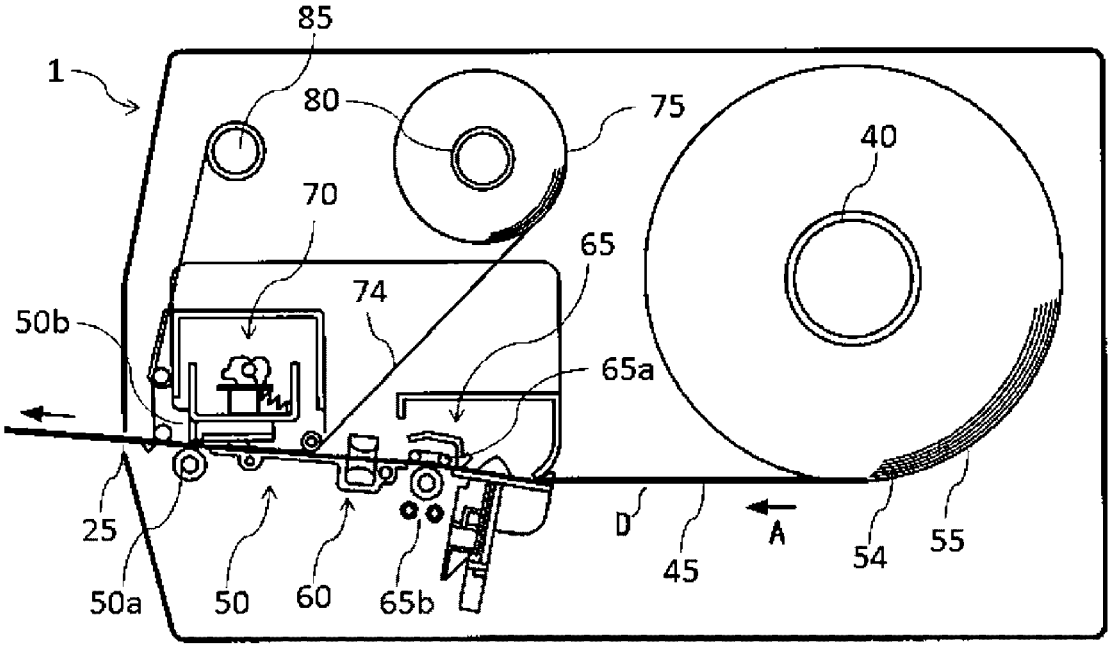
FIG. 2 is a sectional view of the label printer.

FIG. 2 is a sectional view of the label printer 1 according to the embodiment.

The label printer 1 of the embodiment is configured as a line type label printer 1. Such a label printer 1 has a transport path 45 for guiding the label 54 which is a recording medium held in the sheet holding unit 40 in a casing, and has a printing unit 50 in the middle of the transport path 45.

The label 54 has an adhesive layer on an adhesive surface to a mount, and the label 54 and the mount can be separated as necessary. Hereinafter, the label 54 and the mount are combined to form a sheet D. The sheet roller 55 is formed by rolling the sheet D in a roller shape and is rotatably held by a sheet holding unit 40.

The transport path 45 is a path for transporting the sheet D from the sheet holding unit 40 to the discharge port 25. In the transport path 45, there are the printing unit 50, a label sensor 60 that detects the presence or absence of the label 54 on the upstream side of the printing unit 50, and a transport unit 65. The transport unit 65 includes a transport roller 65*a* and a pinch roller 65*b*. The transport roller 65*a* and the pinch roller 65*b* are provided so as to face each other across the transport path 45. The transport unit 65 rotatably drives these rollers to transport the sheet D along the transport path 45, and discharges the sheet D from the discharge port 25.

The printing unit 50 includes a platen roller 50*a* and a thermal head 50*b*. The platen roller 50*a* and the thermal head 50*b* are disposed so as to face each other through the transport path 45. The sheet D and an ink ribbon 74 to be described later are transported between the platen roller 50*a* and the thermal head 50*b*. The thermal head 50*b* is provided with a head moving mechanism 70 and a heating element (not shown).

A plurality of heating elements are disposed at predetermined intervals in the direction (main scanning direction) perpendicular to the transport direction A of the sheet D, in the axial direction of the platen roller 50*a*. The printing unit 50 performs printing by each heating element applying heat to the sheet D and the ink ribbon 74.

The head moving mechanism 70 is a mechanism for varying the distance between the thermal head and the platen roller. The head moving mechanism 70 uses a solenoid and a spring to move the thermal head 50*b* up and down. The head moving mechanism 70 may have a head moving function for separating the thermal head 50*b* from the platen roller 50*a* by using, for example, an electric actuator.

Although a configuration of moving the head moving mechanism 70 has been described as an example of a clamping mechanism, a configuration in which the distance between the thermal head and the platen roller can be varied by moving, for example, the platen roller may be adopted.

The label sensor 60 is disposed between the transport unit 65 and the printing unit 50 along the transport path 45, and detects the presence or absence of the label 54 in the sheet D. As the label sensor 60, for example, a transmissive sensor configured with a light emitting unit and a light receiving unit opposed to each other is used. The transmissive sensor determines the presence or absence of the label 54 by measuring the intensity of the light received by the light receiving unit with respect to the transmitted light emitted from the light emitting unit, and detects the peak of the intensity at the center of a portion having only the mount between two consecutive labels 54 (hereinafter referred to as a gap g).

The ink ribbon roller 75 is formed by winding the ink ribbon 74 in a roller shape and is rotatably held by a ribbon holding unit 80. The ink ribbon 74 merges with the transport path 45 on the upstream side of the printing unit 50, is directed upward after passing through the printing unit 50, and is wound up on a ribbon winding unit 85. When passing through the printing unit 50, the ink ribbon 74 is transported at the same speed as and overlapping with the sheet D, and receives heat from the thermal head 50*b* and is thermally transferred to the sheet D.

The discharge port 25 discharges the transported label 54. In the present embodiment, an example in which the printed sheet D is discharged from the discharge port 25 is described, but a separation guide may be disposed in the vicinity of the discharge port 25 inside the apparatus. The separation guide separates the label 54 from the mount by bending the sheet D at a sharp angle immediately before the discharge port 25, and discharges the separated label 54 from the discharge port 25. Incidentally, when the separation guide is used, the mount may be wound up on a mount winding mechanism.

Figure 3:
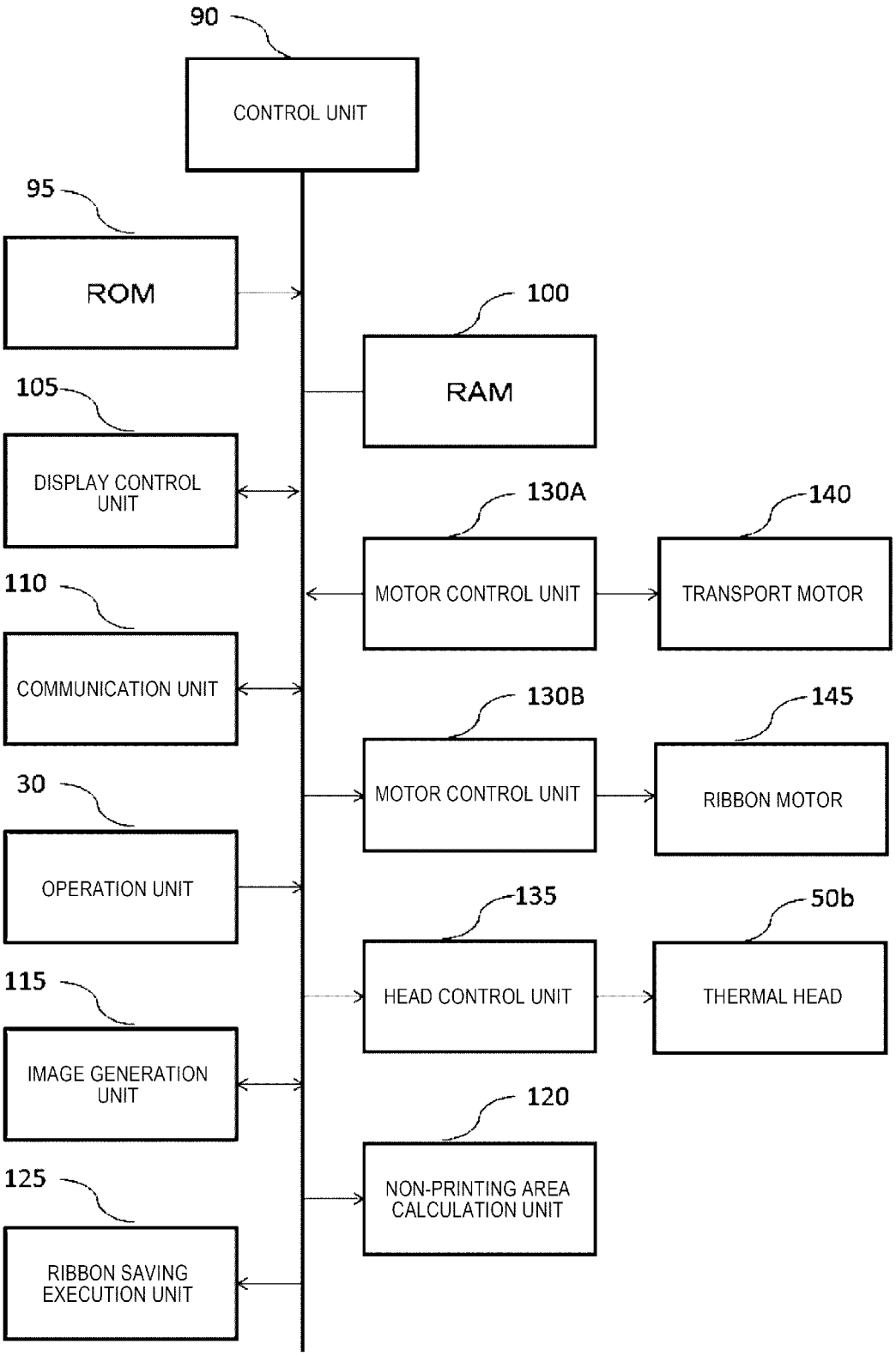
FIG. 3 is a block diagram of the label printer.

FIG. 3 is a control block diagram of a label printer 1 of the present embodiment. The label printer 1 includes a control unit 90, a ROM 95, a RAM 100, a display control unit 105, a communication unit 110, an operation unit 30, an image generation unit 115, a non-printing area calculation unit 120, a ribbon saving execution unit 125, a motor control unit 130A, a motor control unit 130B, a head control unit 135, a transport motor 140, a ribbon motor 145, and a thermal head 50*b*. These are communicably connected to each other through a bus line.

The control unit 90 includes a CPU that controls the overall operation. Operation information, setting information, operation programs, and the like are stored in the ROM 95, and various types of processing information are stored in the RAM 100. The display control unit 105 controls the display unit 35, and the communication unit 110 communicates with an external host computer or the like. The operation unit 30 includes, for example, various input keys for an operator to manually input data.

The image generation unit 115 which is an example of an image acquisition unit draws print data to be printed on the label 54 such as characters and two-dimensional barcodes in a buffer. The communication unit 110 acquires, for example, information on the print data as a print command from a host computer or the like.

The non-printing area calculation unit 120 and the ribbon saving execution unit 125 to be described later, which are an example of the configuration of the non-printing area specifying unit, specify a non-printing area to be subjected to ribbon saving to be described later. The non-printing area calculation unit 120 calculates the dimension of the non-printing area from the print data drawn in the buffer by the image generation unit 115 and the dimension of the gap g previously input by the user. The dimension of the gap g may be calculated by the label sensor 60, for example.

The motor control unit 130A controls the transport motor 140 rotatably driving the transport roller 65*a*, the pinch roller 65*b*, and the platen roller 50*a* constituting the transport unit 65. Further, the motor control unit 130B controls the ribbon motor 145 that rotatably drives the ribbon winding unit 85. In a state where the thermal head 50*b* is actuated to a head-up state, the motor control unit 130B stops driving of the ribbon motor 145.

The head control unit 135 controls the head moving mechanism 70 to raise and lower the thermal head 50*b* and controls printing and non-printing on the label 54. Further, the head control unit 135 controls the heat generation state of the heating elements of the thermal head 50*b*.

Here, the ribbon saving processing will be described. The ribbon saving is intended to reduce the consumption of a ribbon, by stopping the transport of the ink ribbon 74 to an area where printing is unnecessary. In other words, in ribbon saving, only sheet D is transported to the area where printing is unnecessary.

Specifically, when performing ribbon saving, the head control unit 135 controls the head moving mechanism 70 so as to actuate the thermal head 50*b* to a head-up state. Further, the motor control unit 130B stops driving of the ribbon motor 145. The transport unit 65 continues to transport the sheet D during this time. Next, when the sheet D is transported and the thermal head 50*b* reaches the printing area again, the head control unit 135 controls the head moving mechanism 70 so as to actuate the thermal head 50*b* to a head-down state. In addition, the motor control unit 130B resumes driving of the ribbon motor 145 according to the head-down state of the thermal head 50*b*, and performs printing.

The ribbon saving execution unit 125 determines whether or not to perform the above-described ribbon saving, based on the dimension of the non-printing area calculated by the non-printing area calculation unit 120. If it is determined that the dimension of the non-printing area is not less than a predetermined threshold S (mm), the ribbon saving execution unit 125 performs ribbon saving. On the other hand, if the dimension of the non-printing area is less than S, since the head-up and head-down of the thermal head 50*b* are not in time with respect to the transport of the sheet D through the non-printing area, the ribbon saving execution unit 125 does not perform ribbon saving.

Therefore, the threshold S is set based on a dimension M in which the sheet is transported during the time T until the head moving mechanism 70 actuates the thermal head 50*b* to a head-down state again after actuating it to a head-up state. For example, if the time T is a fixed value, the dimension M is a value depending on the printing speed (transport speed). In other words, the faster the printing speed, the shorter the dimension M becomes. Incidentally, if the threshold S is not less than the dimension M, it may be set automatically, for example, or may be set by the user.

Figure 4:
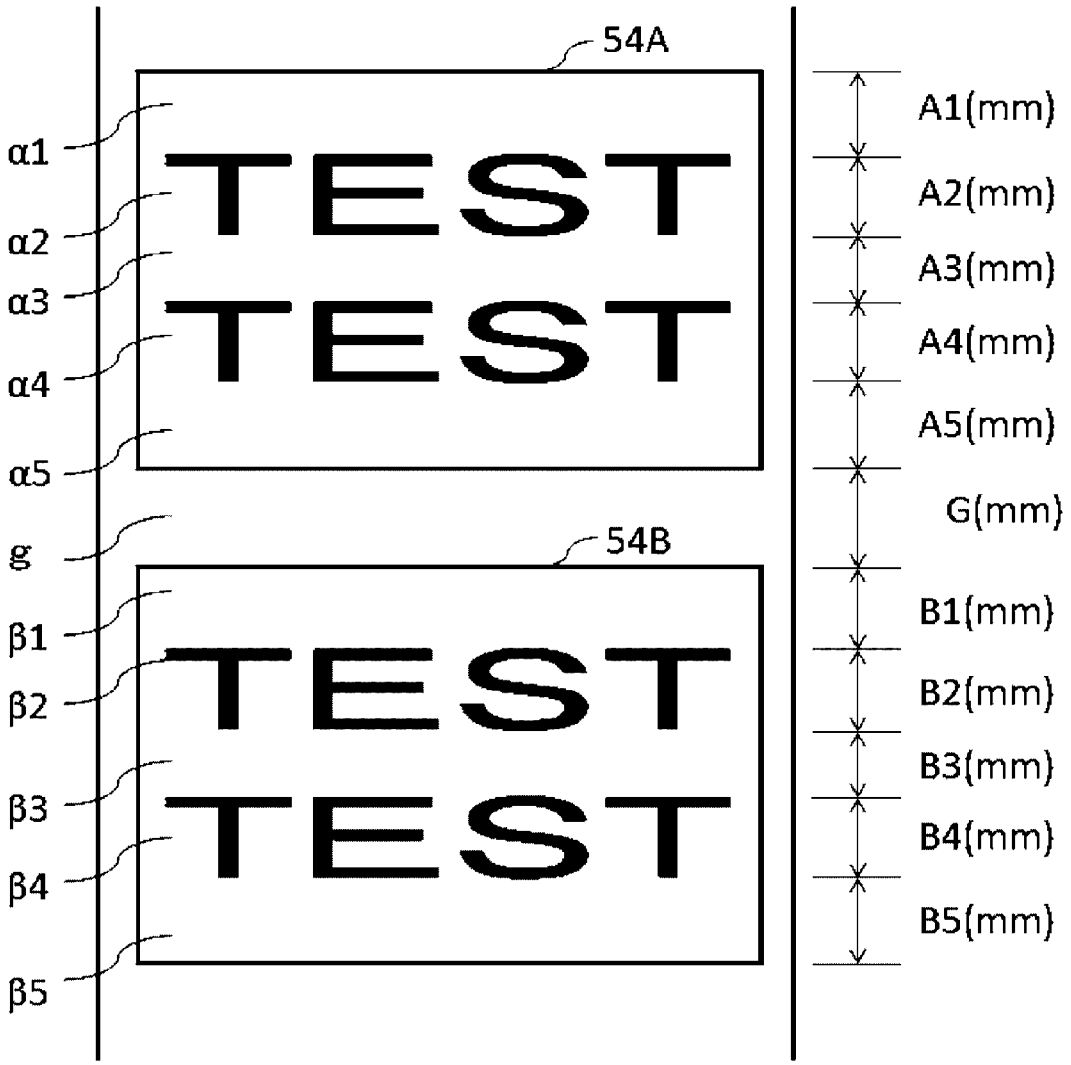
FIG. 4 is a plan view illustrating conditions for ribbon saving.

FIG. 4 is a plan view illustrating conditions for ribbon saving according to the embodiment. The first print data 54A and the second print data 54B are the print data of two consecutive labels 54 drawn in the buffer by the image generation unit 115. It is assumed that these print data 54A and 54B are printed on the label 54 from the top of the first print data 54A toward the bottom of the second print data 54B by the thermal head 50*b*.

In the two print data 54A and 54B, the areas α2, α4, β2, and β4 are printing areas, and the areas α1, α3, α5, β1, β3, and β5 are non-printing areas. As mentioned above, ribbon saving is performed in a non-printing area having a dimension not less than the threshold S.

The ribbon saving execution unit 125 in the present embodiment further determines whether or not to perform ribbon saving over two print data 54A and 54B. In other words, in the printing layout of FIG. 4, it is determined whether or not to perform ribbon saving based on the dimension from the area α5 of the first print data 54A to the area β1 of the second print data 54B across the gap g. For example, in the printing layout of FIG. 4, ribbon saving is performed when the sum A5+G+B1 of dimensions of the area α5, the gap g, and the area β1 is not less than the threshold S.

Specifically, with respect to the first print data 54A developed by the image generation unit 115, the non-printing area calculation unit 120 calculates the dimensions of the printing area and the non-printing area on the print data as illustrated in FIG. 4. Thereafter, the ribbon saving execution unit 125 specifies a non-printing area satisfying conditions for ribbon saving (hereinafter referred to as a ribbon saving area), from the result calculated by the non-printing area calculation unit 120.

For example, with respect to the area α1, it is assumed that the dimension A1 of the area α1 is less than the threshold S. In this case, ribbon saving is not performed in the area α1. On the other hand, if A1 is not less than the threshold S, ribbon saving is performed in the area α1.

Similarly, it is determined whether or not A3 and A5 are not less than the threshold S also with respect to the areas α3 and α5 which are the non-printing areas.

Here, if it is determined that the dimension A5 of the area α5 which is the last non-printing area of the first print data 54A is not less than the threshold S, the ribbon saving execution unit 125 performs ribbon saving on the gap g and the following second print data 54B. For example, when the area β1 which is located at the tip of the second print data 54B is the non-printing area as illustrated in FIG. 4, ribbon saving is performed in the area X5, the gap g, and the area β1. On the other hand, if the area β1 is the printing area, ribbon saving is performed only between the area α5 and the gap g.

On the other hand, ribbon saving when the dimension A5 of the area α5 is less than the threshold S will be described. Originally, ribbon saving is not performed in the area α5. However, in the last non-printing area of the first print data 54A such as α5, it is determined whether or not to perform ribbon saving, based on the gap g and the area β1 located at the tip of the following second print data 54B, in addition to the area α5. For example, if the area β1 is a non-printing area, when the sum A5+G+B1 of the dimensions of the area α5, the gap g, and the area β1 is not less than the threshold S, even if each of A5, G, and B1 is less than the threshold S, ribbon saving is performed in the area α5, the gap g, and the area β1. If the area β1 is the printing area, the ribbon saving execution unit 125 may determine whether or not to perform ribbon saving with the sum A5+G of the dimensions of the area α5 and the gap g.

These ribbon saving processes are continued until there is no print command to be printed on the label 54. If the calculation of the non-printing area for the second print data 54B is not completed when the printing of the first print data 54A is completed, the transport of the label 54 is stopped until the calculation of the non-printing area is completed.

Figure 5:
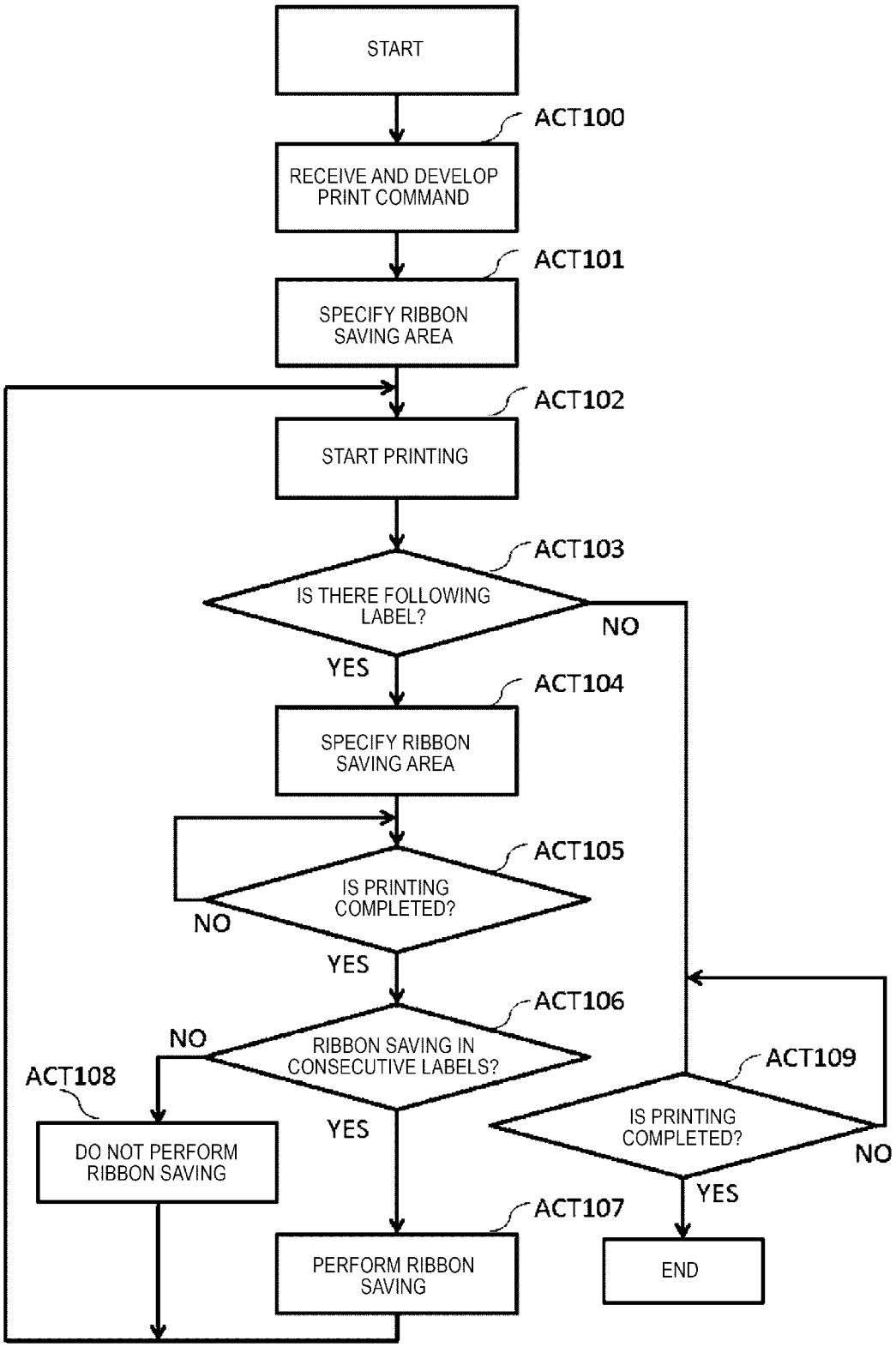
FIG. 5 is a flowchart of a ribbon saving process.

FIG. 5 is a flowchart illustrating a ribbon saving process of the label printer 1. Here, the printing layout illustrated in FIG. 4 will be described as an example.

When the communication unit 110 receives a print command through the communication interface, the image generation unit 115 develops first print data 54A to be printed on a first label 54 from the print command into the image memory (Act100). The non-printing area calculation unit 120 calculates the dimensions A1, A3, and A5 of the areas α1, α3, and α5 which are non-printing areas, based on the print data developed by the image generation unit 115, respectively. Further, the ribbon saving execution unit 125 specifies the ribbon saving areas based on the calculated dimensions (Act101).

Upon completion of the specification of the ribbon saving area of the first print data 54A by the ribbon saving execution unit 125, the transport unit 65 transports the label 54, and the printing unit 50 starts printing (Act102). At this time, the ribbon saving is performed as described in FIG. 4 in an area satisfying the conditions for ribbon saving.

Furthermore, if there is second print data 54B to be printed on a second label 54 (YES at Act103), the image generation unit 115 develops the print data. Whether or not there is the second print data 54B is determined, for example, based on whether or not the communication unit 110 receives a print command related to the second print data. Thereafter, the non-printing area calculation unit 120 calculates the dimensions B1, B3, and B5 of the areas β1, β3 and β5 which are the non-printing areas. The ribbon saving execution unit 125 specifies the ribbon saving area, based on the result calculated by the non-printing area calculation unit 120 (Act104).

Here, it is also determined whether ribbon saving on the first print data 54A and the second print data 54B is performed.

If the printing on the first label 54 is not completed (NO at Act105) at the completion of the process of Act104, the respective units wait without advancing processes until the printing is completed (NO at Act105). Upon completion of the printing process on the first label 54 (YES at Act105), the process of the control unit proceeds to Act106.

When it is determined that ribbon saving is to be performed between two consecutive print data 54A and 54B by the processing of Act104 (YES at Act106), the ribbon saving execution unit 125 performs ribbon saving on the first print data 54A and the second print data 54B (the areas α5 to g to (32 in FIG. 4) (Act107). Thereafter, the sheet D is transported, and when the area β2 which is the printing area reaches the thermal head 50*b*, ribbon saving is completed and printing is started (Act102). When it is determined that ribbon saving is not to be performed between two print data 54A and 54B by the processing of Act104 (NO at Act106), ribbon saving is not performed between two print data 54A and 54B (Act108). Thereafter, printing of the second print data 54B is started in the area β2 (Act102).

A series of processes are continued until there is no print command to be printed next. When there is no print command to be printed next (NO at Act103), the printing process is performed until the printing process on the label 54 which is being printed is completed (NO at Act109), and after all the printing processes are completed (YES at Act109), the control unit 90 completes the series of processes.

In the present embodiment, while the printing unit 50 performs printing on the label 54, the communication unit 110 acquires the print command to be printed on the next label 54, but all printing commands may be acquired before execution of printing on the first label 54. In that case, before execution of printing on the first label 54 by the printing unit 50, the ribbon saving execution unit 125 determines whether or not to perform ribbon saving on all print data including the acquired print command.

As described above, if the sum of the dimension of the last non-printing area of the print data, the dimension of the gap, and the dimension of the non-printing area at the tip of the following print data is not less than the threshold S, even if three dimensions do not satisfy the conditions for ribbon saving, ribbon saving can be performed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a thermal head configured to thermally transfer ink of an ink ribbon to a label;

a platen roller provided opposite to the thermal head;

a ribbon transport unit configured to transport the ink ribbon between the thermal head and the platen roller;

a transport unit configured to transport a sheet carrying the label between the thermal head and the platen roller such that a printed surface of the label and the thermal head face each other across the ink ribbon;

a clamping mechanism configured to clamp the ink ribbon, a printing area of the label, and the sheet between the thermal head and the platen roller;

an acquisition unit configured to acquire a plurality of print commands and draw print data to be printed on each of a plurality of labels based on the acquired plurality of print commands;

a non-printing area specifying unit configured to specify a non-printing area on the sheet based on the print data of consecutive labels after drawing the print data to be printed on each of the plurality of labels; and a control unit configured to control the clamping mechanism to separate the ink ribbon from the sheet and stop transport of the ink ribbon by the ribbon transport unit, when the transport unit transports the non-printing area on the sheet carrying the label between the thermal head and the platen roller.

2. The printer according to claim 1, wherein the acquisition unit is further configured to acquire the plurality of print commands before execution of printing.

3. The printer according to claim 1, the control unit is further configured to, before execution of printing, determine whether or not to perform ribbon saving on the print data including the acquired plurality of print commands.

4. The printer according to claim 3, wherein a threshold is determined, based on a transport speed of the sheet by the transport unit.

5. The printer according to claim 1, wherein when the non-printing area has a dimension not less than a predetermined threshold along a transport direction of the sheet, the control unit separates the thermal head and the platen roller from each other by the clamping mechanism, and stops transport of the ink ribbon by the ribbon transport unit.

6. The printer according to claim 1, wherein the acquisition unit acquires the print data of the plurality of labels after the first label when the transport unit transports the sheet carrying the first label, the non-printing area specifying unit specifies all the non-printing areas from a plurality of print data, and the control unit starts printing by the thermal head, after specifying the non-printing area having a dimension not less than a threshold along a transport direction of the sheet, among all the non-printing areas.

7. A printer control method for controlling a printer including a thermal head configured to thermally transfer ink of an ink ribbon to a label, a platen roller provided opposite to the thermal head, and a clamping mechanism configured to clamp the ink ribbon, a printing area of the label, and a sheet between the thermal head and the platen roller, the method comprising:

transporting the ink ribbon between the thermal head and the platen roller;

transporting a sheet carrying the label between the thermal head and the platen roller such that a printed surface of the label and the thermal head face each other across the ink ribbon;

acquiring a plurality of print commands and draw print data to be printed on each of a plurality of labels based on the acquired plurality of print commands;

specifying a non-printing area on the sheet based on the print data of consecutive labels after drawing the print data to be printed on each of the plurality of labels; and controlling the clamping mechanism to separate the ink ribbon from the sheet and stop transport of the ink ribbon by the ribbon transport unit, when the transport unit transports the non-printing area on the sheet carrying the label between the thermal head and the platen roller.

8. The printer control method according to claim 7, further comprising:

acquiring the plurality of print commands before execution of printing.

9. The printer control method according to claim 7, further comprising:

before execution of printing, determining whether or not to perform ribbon saving on the print data including the acquired plurality of print commands.

* * * * *